United States Patent [19]

Jabs

[11] Patent Number: 4,976,310

[45] Date of Patent: Dec. 11, 1990

[54] SUPPORT MEANS FOR A HEAT EXCHANGER TO RESIST SHOCK FORCES AND DIFFERENTIAL THERMAL EFFECTS

[75] Inventor: Alfred Jabs, Grobenzell, Fed. Rep. of Germany

[73] Assignee: MTU Motoren- Und Turbinen-Union Munchen GmbH, Munich, Fed. Rep. of Germany

[21] Appl. No.: 444,744

[22] Filed: Nov. 30, 1989

[30] Foreign Application Priority Data

Dec. 1, 1988 [DE] Fed. Rep. of Germany ..... 3840460

[51] Int. Cl.[5] ..... F28F 9/00

[52] U.S. Cl. ..... 165/82; 165/67; 165/145; 165/176

[58] Field of Search ..... 122/235 D, 511; 165/67, 165/78, 82, 144, 145, 173, 176

[56] References Cited

U.S. PATENT DOCUMENTS

Re. 21,270 11/1939 Feldmeier ..... 165/78 X
798,684 9/1905 Le Duc ..... 122/511 X
4,262,741 4/1981 Rothenbucher ..... 165/68
4,263,964 4/1981 Masai et al. ..... 165/67
4,809,774 3/1989 Hagemeister ..... 165/163

*Primary Examiner*—Martin P. Schwadron
*Assistant Examiner*—Allen J. Flanigan
*Attorney, Agent, or Firm*—Ladas & Parry

[57] ABSTRACT

A heat exchanger having manifolds in essentially parallel arrangement and having a special-section tube matrix which is arranged in a housing to project into a hot gas stream carried in the housing, the tube matrix being subdivided into sections and containing U-shaped reversal zones, where compressed air to be heated is admitted into the matrix via one manifold, is reversed in its direction and fed to the other manifold. The matrix sections are divided by transverse baffle walls. The ends of transverse supports extending around the tube matrix and the manifolds are connected to the housing in the vicinity of the U-shaped reversal zones, and the manifolds are supported in the housing for axial movement at both ends and are mounted rigidly on one support and axially movably on at least one further support.

29 Claims, 10 Drawing Sheets

E3
20

G
1
G
G1
A3
37
38
A4
i
23
D1
21
i'
i
G2
i"
16'
17'
24
22
D2
i
G3
2
H'

FIG. 7
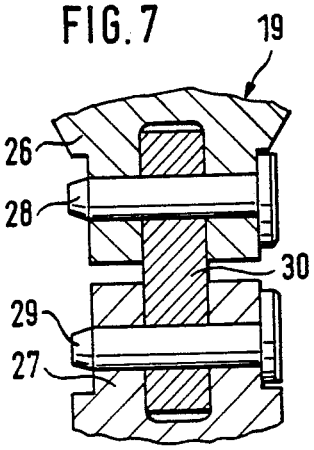
FIG. 8a
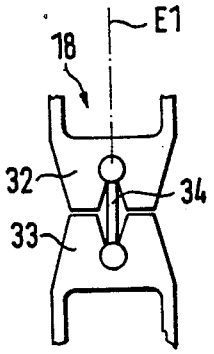
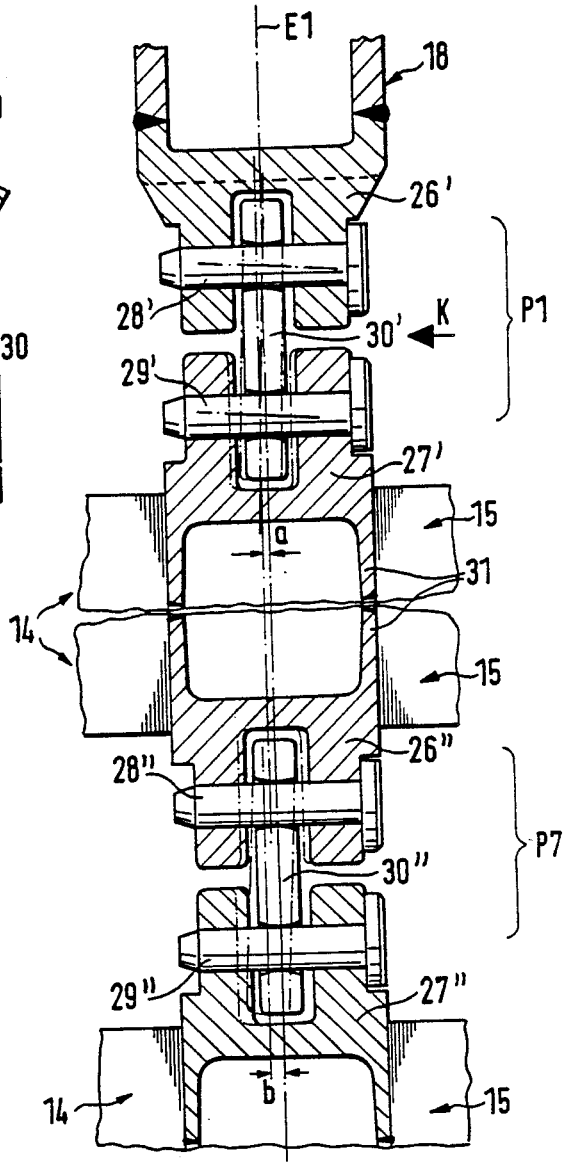
FIG. 8

SUPPORT MEANS FOR A HEAT EXCHANGER TO RESIST SHOCK FORCES AND DIFFERENTIAL THERMAL EFFECTS

FIELD OF THE INVENTION

The invention relates to a heat exchanger and particularly to support means for a heat exchanger to resist shock forces and differential thermal effects.

More particularly, the invention relates to improvements in a heat exchanger of the type which comprises parallel and adjacent inlet and outlet ducts for conveying compressed air wherein the ducts are connected together by a matrix of heat exchange tubes of U-shape which project laterally from the ducts into a housing in which hot gases are conveyed. The compressed air is admitted into the inlet duct and flows through straight legs of the heat exchange tubes, then is reversed in direction in the U-shape bend regions of the tubes and thereafter returns through the other straight legs of the tubes to the outlet duct. Heat exchange takes place between the compressed air flowing in the tubes and the hot gases flowing around the tubes. The tube matrix is subdivided into sections by baffle walls extending transversely of the ducts.

DESCRIPTION OF PRIOR ART

A heat exchanger of this type has been disclosed in DE-PS 36 35 549 and its U.S. equivalent 106,113, now U.S. Pat. No. 4,913,226.

In heat exchangers of this type, it is difficult to cope with drastically different thermal expansions of the cooperating components and assemblies or to compensate for such differential thermal expansion and the desired degree of heat exchange is accompanied by excessively high leakage rates. Excessive differences in thermal expansion between cooperating structural components (housing, tube matrix, ducts) can lead to relatively premature cracking in the material at the connections between the structural components or assemblies.

The problems caused by component expansions and differences in expansion between components is especially significant in such a heat exchanger when it is combined with a gas turbine system, i.e. when the objective is to recover a portion of the heat contained in the system's exhaust gas for use in the thermodynamic cycle, for example, for preheating the combustion air to be fed to the combustion chamber of the gas turbine system, since extremely abrupt load cycles and transient conditions often involve drastic temperature differences and hence differences in expansion of the respective cooperating components or assemblies.

The tube matrix of the heat exchanger is comparatively easily disruptible and vibration-sensitive when it comes to coping with thermal expansions or differences in thermal expansion of individual heat exchange tubes, and also with respect to local dynamic loads in a vertical or horizontal direction due, for example, to jolts, and shock forces. Such jolts and shock forces, especially in the horizontal directions, may result from the employment of such a heat exchanger in vehicles, such as, on armored vehicles, which have to travel on rugged terrain.

It is also difficult to cope with such thermal and dynamic load requirements when the heat exchanger must be easy to assemble and be comparatively light in dry weight.

The heat exchanger cited above affords no tangible approach to the solution of the stated problems, especially since it provides only for compressing the tubes in the divided sections at the bend regions thereof to achieve uniform distribution of the hot gas mass flow over the entire tube matrix including the U-shaped bend regions and straight leg sections.

SUMMARY OF THE INVENTION

An object of the invention is to provide a heat exchanger of the above type which overcomes the stated problems with a minimum of structural complexity.

A further object of the invention is to provide a heat exchanger having support means to resist shock forces and differential thermal effects such that the heat exchanger is comparatively simple in construction, is light in weight and is easy to assemble.

In accordance with the invention a plurality supports are spaced longitudinally along the ducts and extend transversely thereof and the supports are connected at their ends to the housing such that the supports and the housing can undergo relative movement due to differential thermal expansion and contraction. The connections are made in the vicinity of the U-shaped bend regions of the heat exchange tubes. The ends of the ducts are supported from the housing for relative movement longitudinally along ducts and the ducts are rigidly connected to one of the supports and are connected to another of the supports to provide relative movement therebetween longitudinally of the ducts.

This support arrangement permits horizontal and vertical dynamic loads produced, for example, by road jolts, to be mainly transferred externally of the heat exchanger. Assuming local rigid mounting in a transverse duct plane on an associated outer or upper support, operatively thermally induced changes in length of the remaining duct sections remain relatively moderate, and can be absorbed by the opposite direct or indirect mounting on at least one further support, said mounting permitting locally restricted movement in the longitudinal direction of the duct, which can be transformed into axial displacement at the housing connection of the ducts plus associated sections of the tube matrix.

In accordance with the present invention, therefore, no special high-cost "backbone" is needed in the respective duct which would considerably increase the dry weight of the heat exchanger. Rather, the invention employs, in the case of ducts assembled in sectional lengths, with local inner reinforcement and connecting means at the ends of the duct sections in respective rigid or movable mounting zones or in respective transverse zones associated with the supports, whose planes intersect the ducts substantially at right angles.

In accordance with the present invention, vertical dynamic loads on the tube matrix resulting, for example, from road jolts, are resiliently absorbed predominantly by the supports and to a much lesser degree by the respective connecting means, whereas horizontal dynamic loads in the direction of the longitudinal duct are absorbed by the support thereby ensuring rigid mounting. Horizontal dynamic loads in the longitudinal direction of the matrix tube sections or in the longitudinal direction of the baffle walls can be transferred, via resilient members connected to the heat exchanger housing in the respective outer U-shaped areas of the tube matrix.

BRIEF DESCRIPTION OF THE FIGURES OF THE DRAWING

The invention is described more fully with reference to the accompanying drawing, in which:

FIG. 7 is a sectional view of a rigid mounting means of the heat exchanger;

FIG. 8 is a sectional view taken on line H—H in FIG. 5;

FIG. 8*a* illustrates an alternative mounting and attaching means for that in FIG. 8;

DETAILED DESCRIPTION OF PREFERRED EMBODIMENTS

Figure 1:
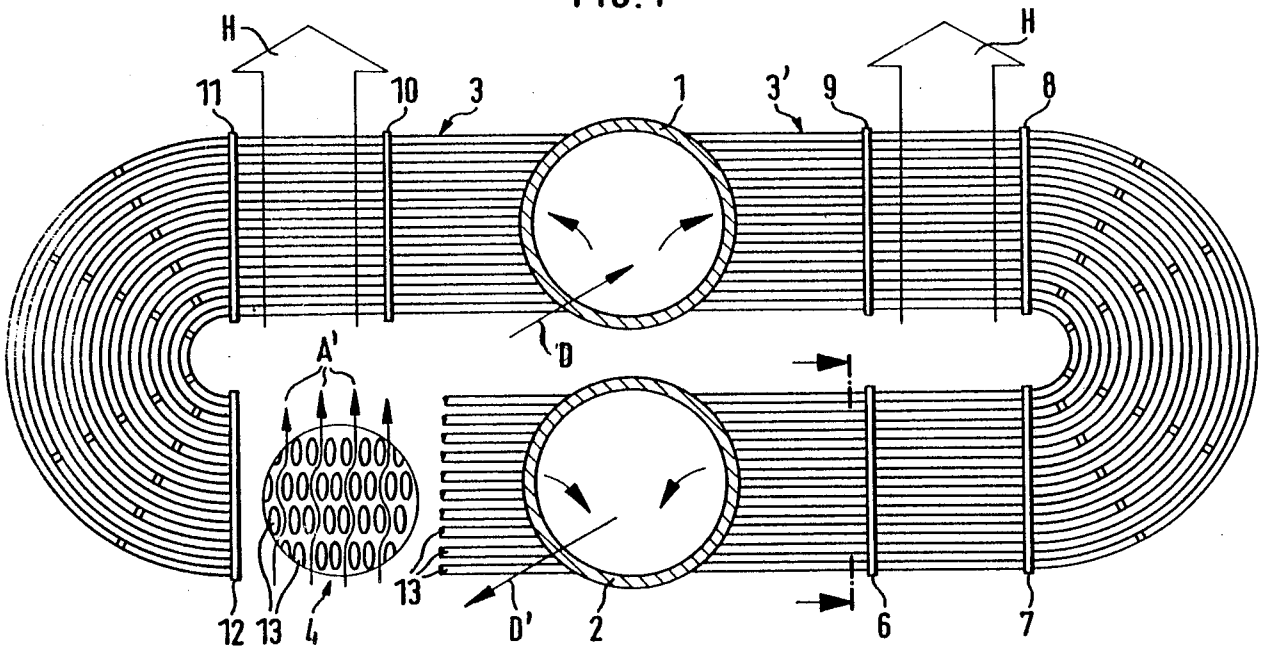
FIG. 1 is a side elevational view illustrating schematically a heat exchanger without its housing.

FIG. 1 diagrammatically illustrates a high temperature cross-counterflow heat exchanger of the invention. The heat exchanger comprising two parallel manifolds or ducts 1, 2. Connected to the ducts 1, 2 at respectively opposite sides thereof are a matrix 3 and a matrix 3' of U-shaped heat exchange tubes 13. The tubes extend into the path of flow of hot gases H. Each matrix consists of a large number of the individual tubes 13 which are of oval cross-section as readily visible in the broken away section at the bottom left portion of FIG. 1. It can also be seen from this section that the hot gas flow H travels essentially in the form of undulating paths A around the tubes of the matrix. For this purpose, the individual tubes 13 are arranged with their long axes in the direction of the gas flow H.

In operation, compressed air D is fed to the upper duct 1 and flows laterally therefrom into the straight legs of the tubes 13. In the outer bend region of each tube matrix, the direction of compressed air flow is reversed and the compressed air travels through the lower straight legs of the tubes 13 into the lower duct 2. From duct 2 the heated compressed air flows in the direction of arrow D' (out of the plane of the paper) to a suitable utilization means (not shown), for example, the combustion chamber of a gas turbine engine.

Spacers 6–12 are mounted at various locations along the heat exchange tubes 13 matrixes 3,3' to maintain the spacing of the tubes. The spacers 6–12 may be constructed as packing elements of a flexible, vibration-damping material in which the tubes 13 of each matrix 3, 3' are supported to permit relative movement between the tubes especially in the longitudinal direction of the tubes. The packing elements forming the spacers, can be constituted as individual longitudinal strips or an assembly of practically endless strips pulled through the tube matrix.

The respective tube array of each matrix consists of rows of oval tubes 13 in parallel arrangement, where the tube rows are laterally offset to provide undulating flow path A for gases H while ensuring the necessary degree of hot gas blockage. Although not shown in the drawing, each oval tube may have two distinct internal air passages formed by a central web.

Figure 2:
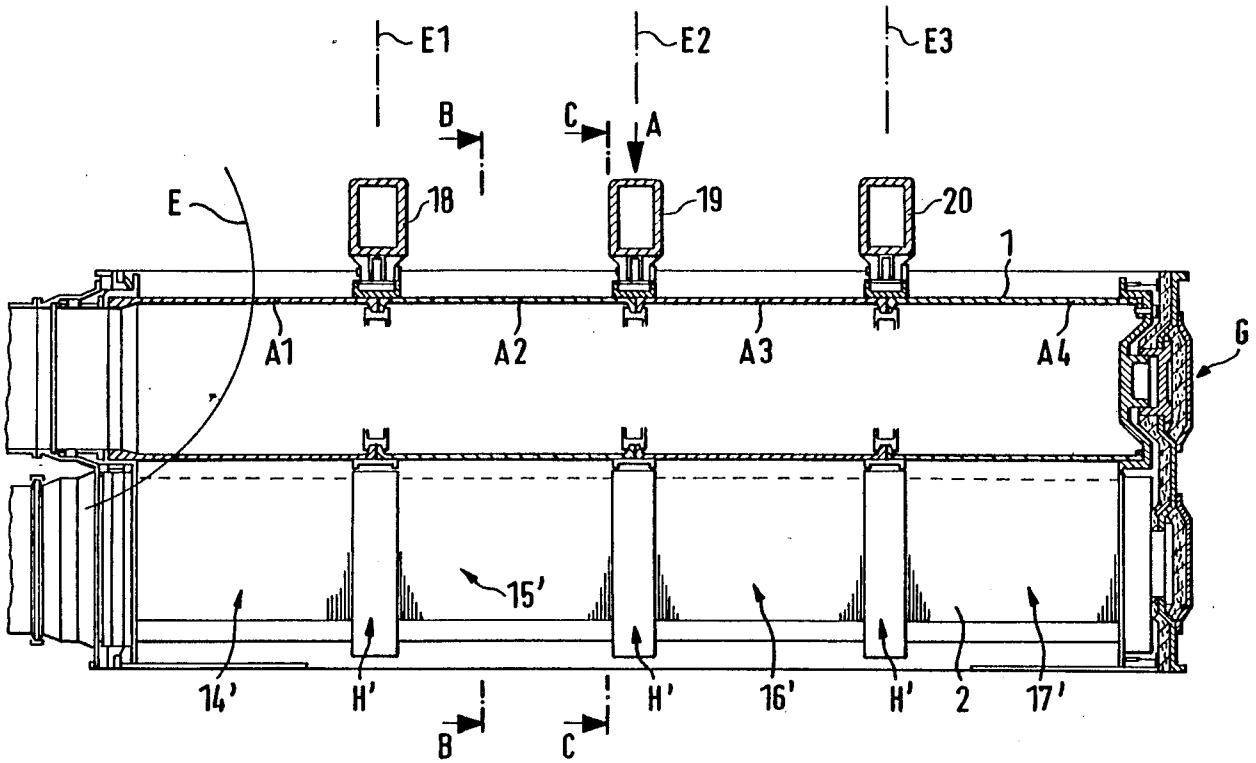
FIG. 2 is a sectional view taken on line D—D in FIG. 4.
Figure 3:
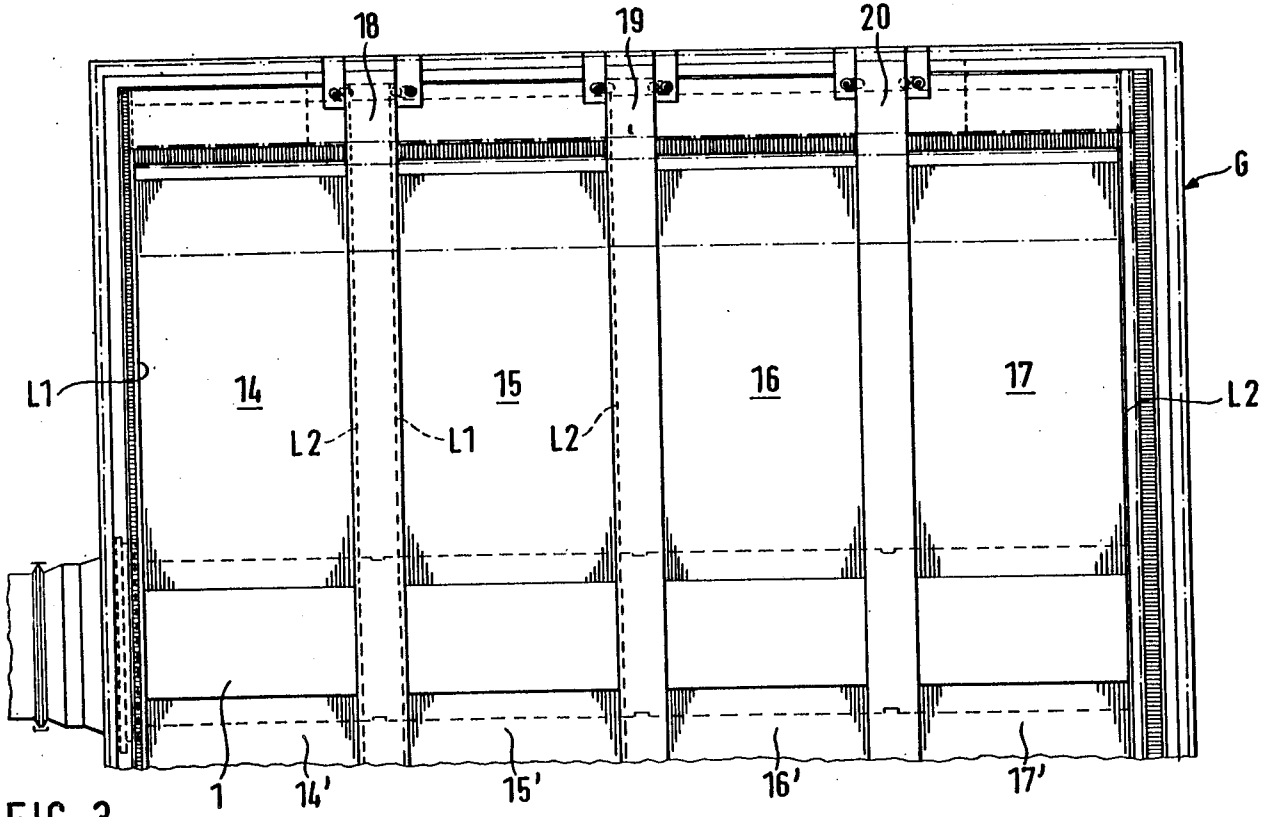
FIG. 3 is a plan view of the heat exchanger as seen in the direction of arrow A in FIG. 2.
Figure 6:
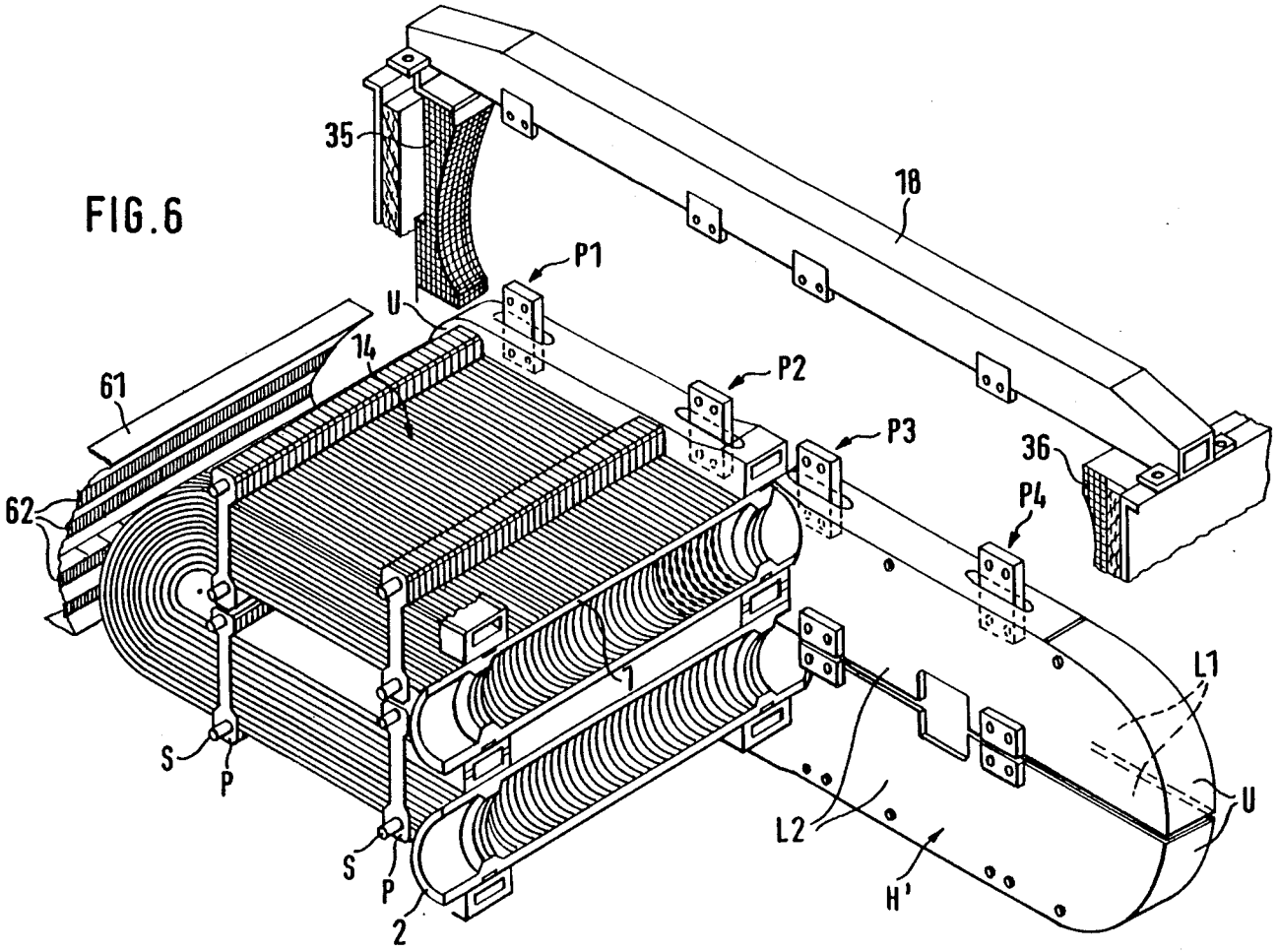
FIG. 6 is an exploded perspective view, partly broken away, of a portion of the heat exchanger.
Figure 9:
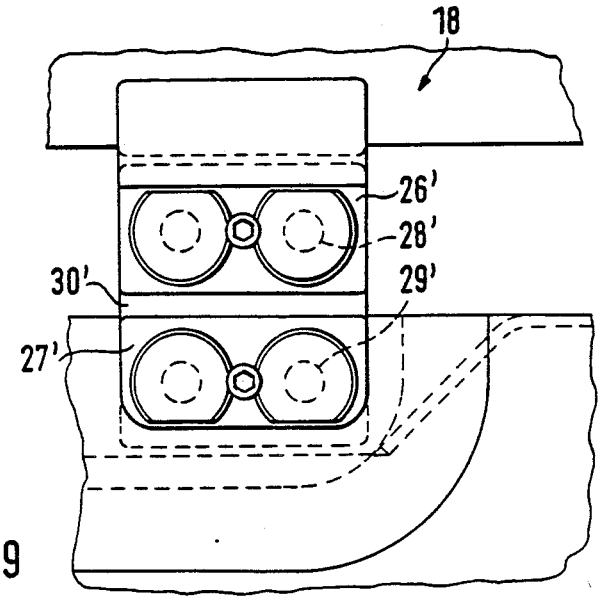
FIG. 9 illustrates a portion of the tube mounting and connecting means as seen in the direction of arrow K in FIG. 8.

As shown in FIGS. 2 and 3 each tube matrix 3, 3' is subdivided into respective sections 14, 15, 16, 17, and 14', 15', 16', 17' by baffle walls H' extending transversely of the manifolds 1,2 over the entire length of the associated tube matrix. Each baffle wall H' includes spaced wall elements L1 and L2. Each of the subdivided sections is laterally bounded at its sides by a baffle wall element L1 or L2. FIG. 6 shows the wall elements L1 and L2 adjoining section 14 and forming respective hollow wall H' between adjacent sections 14, 15. The baffle wall is shaped in correspondence with the U-shaped tube matrix to block the latter laterally and form a blockage means for passage of hot gas.

In accordance with the basic inventive concept, supports 18, 19, 20 (FIGS. 2 and 3) are spaced longitudinally along the manifolds 1, 2 and are connected at their ends to the housing G in the deflection zone region (the U-shaped bend region of the heat exchange tubes). The connections of the supports 18, 19, 20 to the housing G take up differential thermal expansion and contraction in a manner to be explained in detail later.

As will be described more fully with reference to FIGS. 2, 2*a* and 12, the manifolds 1, 2 are, in accordance with the basic concept of the present invention, allowed some axial floatability at both ends in housing G and they are mounted rigidly on one support, (support 19), and axially movably on at least one further support 18, 20.

As also seen in FIGS. 2 and 3 the respective supports 18, 19, 20 are attached to the housing G in equally spaced transverse planes E1, E2, E3 along the two manifolds 1,2, which are arranged in parallel configuration one above the other, the respective transverse planes of the supports intersecting the longitudinal center lines of the manifolds 1, 2 at right angles. In this arrangement the manifolds 1, 2 and their associated sections of the tube matrix are mounted rigidly on the central support 19 in plane E2 and are axially movable on the two outer supports 18, 20.

Figure 2A:
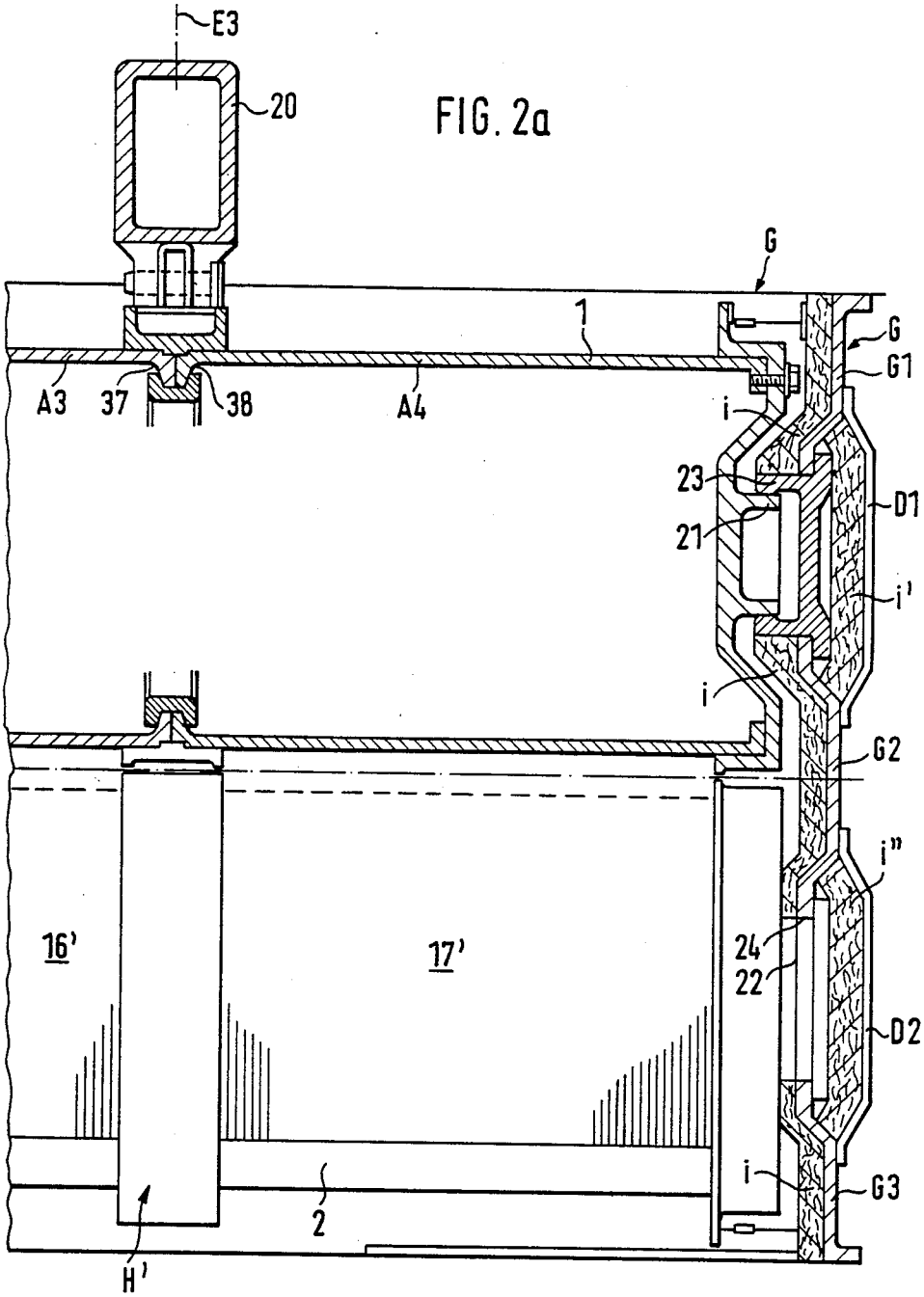
FIG. 2*a* is an enlarged view of a portion of FIG. 2.

FIG. 2*a* shows different arrangements for axially movably supporting manifolds 1,2 from the housing. Manifold 1 includes a cylindrical end piece 21 forming a tube head which is slidably mounted in a thermally insulated sleeve 23. Manifold 2 has a tube head formed by an end piece 22 which is slidably engaged in a housing recess 24. Sections G1, G2, G3 of housing G are lined with insulating material i, for example, in the form of metal flat matting, on the side facing the manifolds 1, 2, and where, as it is shown especially in FIG. 2*a*, the respective insulating material i extends to the sleeve 23 and the recess 24. Also seen in FIG. 2*a* are cover pieces D1, D2 of the housing G, plus associated inner insulation layers i' and i'', respectively, which are arranged opposite the sleeve 23 and the recess 24. The manifolds 1,2 can be axially movably supported by one or both of the arrangements shown in FIG. 2*a*.

In a further advantageous aspect of the present invention, the thermally insulated sleeves 23 or the housing recess 24, have a higher coefficient of thermal expansion than the inner cylindrical end pieces 21, 22.

In an advantageous arrangement of the heat exchanger of the present invention, the subdivided sections 14–17 or 14′–17′ of the tube matrix 3 are composed of the U-shaped tubes 13 of oval cross-section which project transversely into the hot gas stream H in the housing G, the oval tubes internesting with one another and being connected along their straight leg sections by support members S, P forming or accommodating special-section spacers 6 to 12 (cf. FIG. 6) to support 19 in a rigid manner and to at least one further support 18 or 20 in a manner permitting movement in the longitudinal direction of the manifolds.

Figure 5:
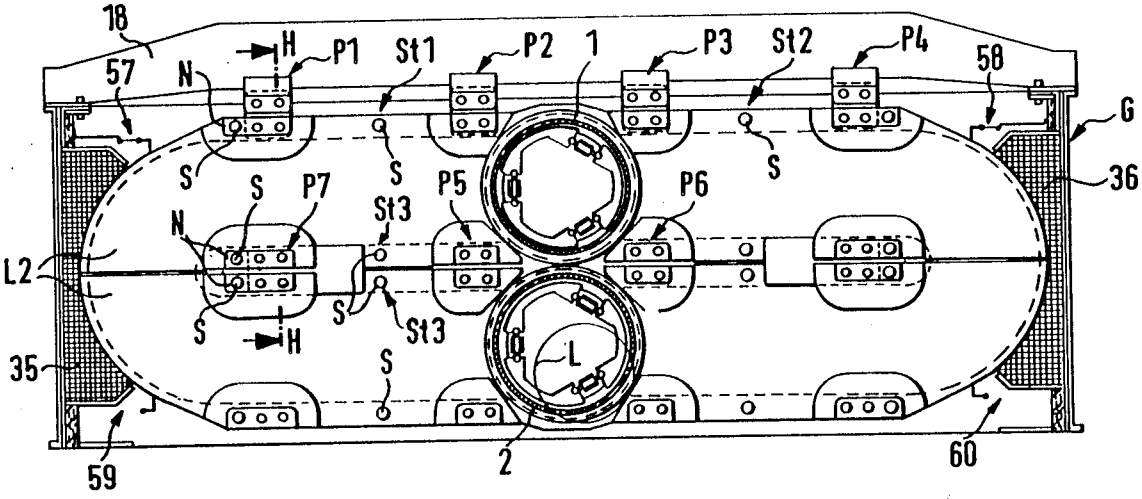
FIG. 5 is a sectional view taken on line C—C in FIG. 2.

As it will be seen especially from FIGS. 5 and 6, each baffle wall e.g. wall L2, is optionally composed of two halves split symmetrically in the longitudinal direction of the heat exchange tubes.

It is also shown in FIG. 6 that two opposite congruent, symmetrically split baffle walls L2, L1 are dimensioned to correspond to the outer U-shaped contour of the matrix 3, 3′ and define hollow wall H′ arranged between adjacent divided sections 14 and 15, respectively, as indicated in FIG. 2.

As also apparent in the drawings, the subdivided sections 14, 15, 16, 17 or 14′, 15′, 16′, 17′ and the respective wall element of a baffle wall, e.g. wall element L2, are connected to supports 18, 19 in a respective plane E1 or E2, transverse to the manifolds 1, 2—movably in the longitudinal direction of the manifold, or rigidly, at several points P1, P2, P3 and P4 on the respective support 18 and 19, said points being spaced along the tube matrixes.

At the respective points, e.g. P2, P3 or P5, P6 (FIG. 5), the mounting anchored to the manifold can optionally be movable or rigid in the respective transverse plane.

At relevant points P1 to P6, rigid mounting on the central support 19 is provided in plane E2 (FIG. 2) for the manifolds 1, 2 plus adjoining portions of the subdivided sections 15′ 16′. In plane E2 the baffle wall H′ are rigidly mounted directly on the respective support 19 at points St 1, St 2, St 3 via the rods S. In analogy to point P1, FIG. 7 illustrates an alternative rigid mounting arrangement, for example, on the support 19 (cf. FIG. 2), by connecting plates 30 which are fixedly anchored between adjacent clevises 26, 27 by means of bolts 28, 19.

FIG. 8 illustrates an alternative movable mounting arrangement in plane E1 (FIG. 2) on the support 18 for the points P1, P7 (FIG. 5). The movable mounting means for point Pl are formed by connecting plates 30′, which move locally on bolts 28′, 29′ to take up clearance between the connecting plates and the corresponding clevises 26′ 27′. An analogous configuration (26″ to 30″) is applicable to mounting point P7.

Figure 4:
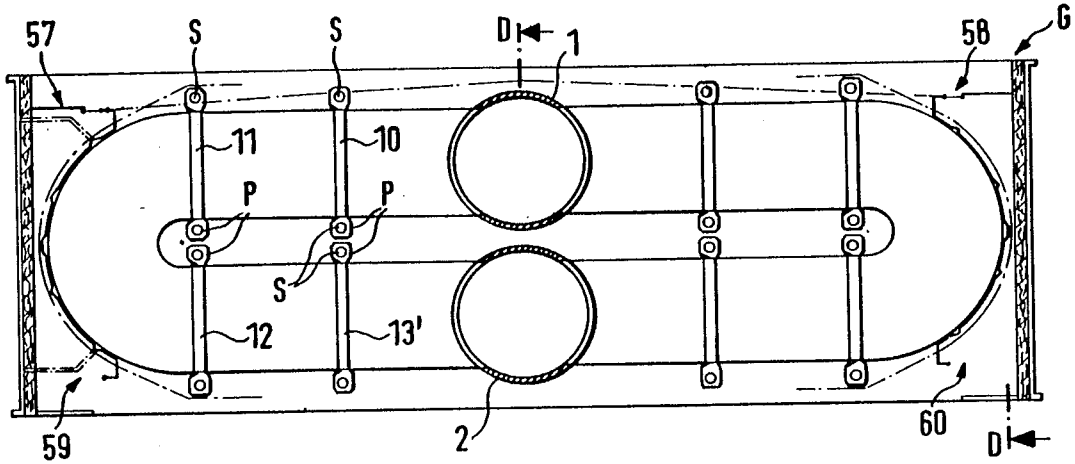
FIG. 4 is a sectional view taken on line B—B in FIG. 2.

As seen from FIG. 5 the clevises (27′, 26″, 27″) have ends or noses N projecting axially over the plates 30′, 30″ (FIG. 8) to which are anchored the adjoining subdivided tube sections, e.g. 14, 15 by cross-rods S (FIG. 4).

Using uniformly three-dimensionally offset holes, the baffle wall elements e.g. element L2, of a hollow wall H′ can be seated on the crossroads S or anchored thereto (FIG. 5).

In FIG. 8, the clevises 27′, 26″ form part of a hollow-section body 31, shown in transverse cross section.

It will become apparent from FIG. 5 that the rod-shaped supporting members S are mounted on the respective symmetrically split baffle wall element L2 at points ST1 or ST2 or ST3 located between the mounting points, e.g. P1, P2 or P3, P4 or P7, P5. The baffle wall elements L1, L2 or the hollow walls H′ formed thereby (FIG. 6) are connected to the manifolds, 1,2 by slipping them over the manifolds or otherwise assembling them to the manifolds.

FIG. 8*a* shows an alternative mounting arrangement permitting movement relative to the mounting point P1 in which connecting straps 34 are pivotally carried between adjacent clevises 32, 33 by means of cylindrical end pieces for movement in the respective mounting plane E1 towards the support 18.

In accordance with the present invention, horizontal dynamic loads from the tube matrixes 3, 3′ are absorbed in the longitudinal direction of the manifold by the support 19 located in transverse plane E2 to which the manifolds 1, 2 are rigidly mounted and with which the subdivided tube sections e.g. 15, 16 or 15′, 16′ are connected.

With reference to FIGS. 5 and 6, horizontal dynamic loads from the tube matrixes 3, 3′ in the longitudinal direction of the subdivided sections or the baffle walls L2, L1 can be transmitted to the housing G of the heat exchanger through outer resilient members 35, 36. The members 35, 36 are disposed opposite the outer U-shaped bend regions of hollow-wall H′ and have corresponding concave shapes to cushion movement of the wall H. The resilient members 35, 36 can be a wire cushion made of a chrome nickel steel.

As illustrated in the upper half of FIG. 2, the manifolds, represented by manifold 1, is subdivided into sections A1, A2, A3 and A4 connected to the respective tube sections 14, 15, 16, 17. This construction greatly aids in the assembly and disassembly of the heat exchanger and forms a modular type of construction.

Figure 10:
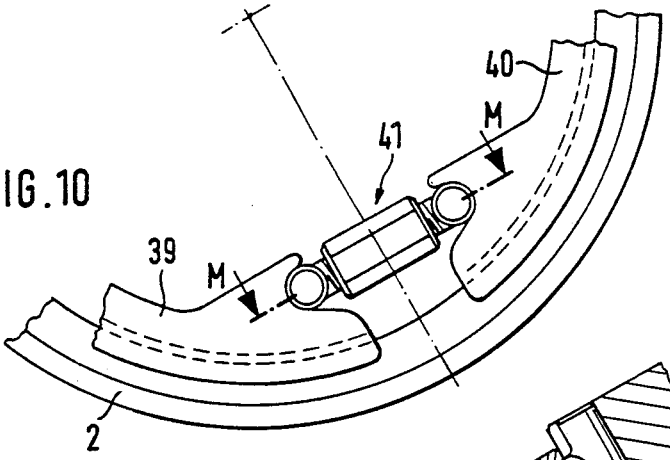
FIG. 10 is an enlarged view of local tube clamping and tensioning means in detail L in FIG. 5.
Figure 11:
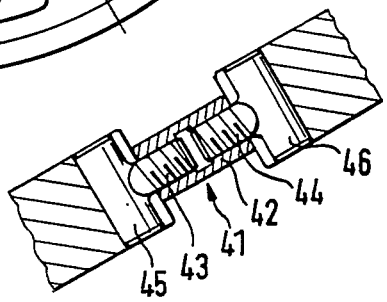
FIG. 11 is a sectional view taken on line M—M in FIG. 10.

As seen in the upper half of FIG. 2*a*, the sections A3, A4 can be clamped together for sealing and tube-stiffening purposes, along mating inner circumferential flanges 37, 38 in transverse plane E3 in correspondence with the position of the associated support 20. This is more clearly illustrated with respect to the manifold 2 in FIG. 10 by way of section L, where preferably three internally circumferentially equally spaced clamping members 39, 40 grip the mating flanges of the tube sections by V-shaped contours of the clamping members and where the clamping force between them is applied by left hand and right hand screw members 41, respectively (cf. FIG. 11). The screw members 41 function as turnbuckles. In accordance with FIG. 11 an adjusting nut 42 engaging threaded pins 43, 44 is provided for the purpose, where the threaded pins 43, 44 have cylindrical end pieces 45, 46 engaging in corresponding grooves in the clamping members 39, 40.

Figure 12:
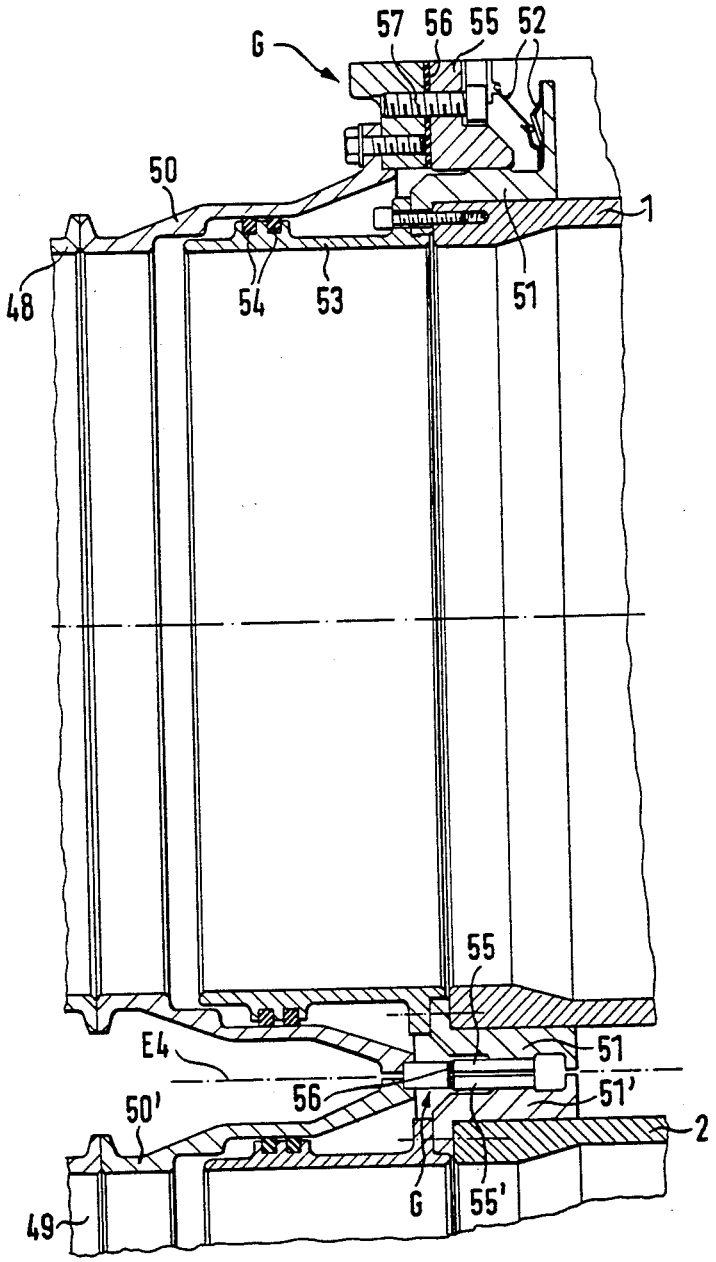
FIG. 12 is an enlargement of detail E in FIG. 2.

FIG. 12 illustrates an embodiment of a tube connector for connecting the left ends of open manifolds 1, 2 to upper rigid inlet pipe 48 and lower rigid outlet pipe 49 to compensate for relative axial movement. In this arrangement, as illustrated with reference to upper manifold 1, an internally stepped pipe section 50 has a flange bolted to the inlet pipe end 48 at one end and is bolted at the other end to the housing G. Seated in an axisymmetrical recess of another cylindrical section 55 bolted to the housing G is a sleeve 51 which is bolted to the forward end of the manifold 1 and which at the radially outer end forms a baffle wall section. Located between sleeve 51 and the facing end surfaces of the housing is a hot gas seal 52 which compensates for relative movement therebetween.

A further pipe section 53 is fixedly bolted to the upper manifold 1 and sleeve 51. While permitting axial movement, the pipe section 53 sealingly engages a local step of the pipe section 50. Sealing elements are supported by the pipe section 53 for contact with a cylindrical inner surface f the pipe section 50. The pipe connection at the lower manifold 2 is similarly constructed. With further reference to FIG. 12 it should be noted that the pipe sections 50, 50' of the two manifolds 1, 2 bear against the housing G in a mutual transverse plane of intersection E4 between the sleeves 51, 51'. The housing G is connected to cylindrical sections 55,55' at the top of FIG. 12 and to flattened sections at plane E4 with interposition of sealing insulation 56.

Figure 13:
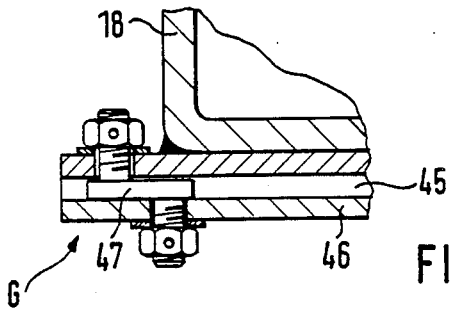
FIG. 13 is a sectional view taken on line G—G in FIG. 14.
Figure 14:
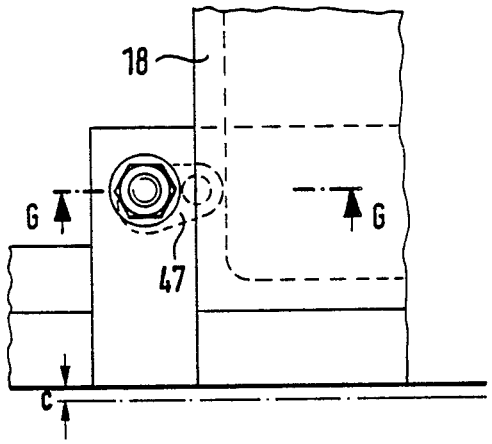
FIG. 14 is a plan view of the connecting arrangement in FIG. 13.

In accordance with the present invention, supports 18, 19 and 20 are bolted to the housing G at their outer ends to compensate for thermal expansion. FIGS. 13 and 14 illustrate such bolted connection to compensate for thermal expansion with reference to support 18. To effect such thermal compensation, members 47 of approximately Z shape are provided to engage in spaces between double plates 45, 46 of the outwardly angled structure of the housing G, members 47 having axially offset eccentric bolts and nuts. This arrangement therefore permits thermally compatible movability (in direction C) of the support 18 relative to the housing G despite the bolted and locally fixed connection of support 18 to housing G.

As it will also be seen from FIGS. 4 and 5, hot gas seals 57, 58, 59 and 60 which compensate for movement are arranged between local baffle walls enveloping the curved region of the tube matrixes 3, 3' (e.g. baffle wall L1 in FIG. 6) and adjoining portions of the housing G. In accordance with FIG. 6 the baffle walls, e.g. wall L1, can in turn be designed to form hot gas seals relative to the adjoining heat exchange tubes in the curved area of the matrix, where use is made of local further brush seals 61.

Although the invention has been described in relation to specific embodiments thereof it will become apparent to those skilled in the art that numerous modifications and variations can be made within the scope and spirit of the invention is defined in the attached claims.

What is claimed is:

1. A heat exchanger comprising a tubular inlet manifold and a tubular outlet manifold for a fluid each having a longitudinal axis, a tube matrix connected to said inlet and outlet manifolds for conveying fluid from the inlet manifold to the outlet manifold, said tube matrix projecting laterally from said inlet and outlet manifolds into the path of travel of a hot gas stream so that the fluid is heated as the fluid travels through the tube matrix from the inlet to the outlet manifold, said tube matrix including heat exchange tubes of U-shape having bend regions in which the fluid being heated undergoes reversal of direction of flow, a housing containing the manifolds and the tube matrix, the hot gas stream being conveyed through the housing for heat exchange with the tube matrix and the fluid therein, a plurality of spaced baffle walls extending transversely of said manifolds in said tube matrix to subdivide said tube matrix into a plurality of sections disposed longitudinally along said manifolds, said manifolds each having opposite ends, means supporting said ends of the manifolds from said housing for movement along said longitudinal, a plurality of supports spaced longitudinally and along the length of said manifolds an extending transversely thereof, means connecting said supports to said housing in the vicinity of the bend regions of the heat exchange tubes such that said supports and said housing can undergo relative movement due to differential thermal expansion and contraction, means rigidly connecting said manifolds to one of said supports and means connecting another of said supports to said manifolds to provide relative movement therebetween longitudinally of said manifolds.

2. A heat exchanger as claimed in claim 1 wherein said tube matrix includes two tube matrix sections extending transversely from said manifolds in opposite directions, said housing including end sections at the bend regions of the two matrix sections, said supports being three in number and being connected at their respective ends to the end sections of the housing, said supports being equally spaced to provide two outer supports and a center support.

3. A heat exchanger as claimed in claim 2 wherein said supports extend in planes perpendicular to said manifolds, said manifolds being rigidly connected to said center support and being connected to said outer supports for relative movement therebetween longitudinally of said manifolds.

4. A heat exchanger as claimed in claim 2 wherein said means which supports the ends of the manifolds from the housing for relative movement longitudinally of the manifolds comprises an end piece on one end of each manifold and a support on said housing slidably receiving said end piece, and thermal insulation means between the manifold and said support of said housing.

5. A heat exchanger as claimed in claim 4 wherein said end piece is cylindrical and said support comprises an insulated sleeve receiving said cylindrical end piece.

6. A heat exchanger as claimed in claim 4 wherein said end piece is cylindrical and said support is constituted by a recess in said housing receiving said cylindrical end piece.

7. A heat exchanger as claimed in claim 4 wherein said support has a coefficient of thermal expansion higher than that of said end piece.

8. A heat exchanger as claimed in claim 1 wherein said U-shaped tubes of the tube matrix have straight legs connected to the manifolds and said bend regions connected to the straight legs, means rigidly connecting one of said supports to the tubes, means connecting another of said supports to the tubes for relative movement longitudinally of the manifolds, each of said connecting means including support members at the straight legs of the tubes of the tube matrix, said support members including spacer means for holding the tubes of the tube matrix in spaced relation from one another.

9. A heat exchanger as claimed in claim 8 wherein each baffle wall is divided longitudinally into two symmetrical half walls which are fitted in said manifolds, said support members comprising rods on said baffle walls.

10. A heat exchanger as claimed in claim 8 wherein each baffle wall includes two spaced wall elements defining a hollow space in each baffle wall, said baffle wall having U shape in correspondence with the U-shaped tube matrix to block the latter laterally and form a blockage means for passage of hot gas.

11. A heat exchanger as claimed in claim 10 wherein each baffle wall element is connected to a respective tube matrix section, each said baffle wall being connected to a respective support at a plurality of locations spaced longitudinally along the baffle wall in a plane perpendicular to said manifolds.

12. A heat exchanger as claimed in claim 11 wherein each said wall is connected to its respective support by either said means for rigid connection or said means for connection for relative movement.

13. A heat exchanger as claimed in claim 12 wherein each of said means for rigid connection or said means for connection for relative movement comprises a first clevis connected to said wall, a second clevis connected to said support, and a plate connected to both said clevises.

14. A heat exchanger as claimed in claim 13 wherein in said means for rigid connection, said plate is tightly fitted in each said clevis.

15. A heat exchanger as claimed in claim 13 wherein in said means for connection for relative movement, said plate is fitted for travel in each clevis for movement longitudinally of said manifolds.

16. A heat exchanger as claimed in claim 15 comprising fastener means connecting said plate and said clevises, said plate being guided for movement on said fastener means.

17. A heat exchanger as claimed in claim 12 wherein each section of the tube matrix includes a lateral projection, at least one clevis including an extension having means for engagement with said lateral projection to connect the clevis and its associated baffle wall to said section of the tube matrix.

18. A heat exchanger as claimed in claim 12 wherein said means for connection for relative movement comprises a strap having opposed portions respectively pivotably connected to said support and to said wall.

19. A heat exchanger as claimed in claim 1 wherein said means which rigidly connects said manifolds to one of said supports is connected to said tube matrix and is constructed to transfer dynamic loads applied to the tube matrix in the longitudinal direction of the manifolds through said one support in plane transverse to said manifolds.

20. A heat exchanger as claimed in claim 1 comprising resilient means in said housing for transferring dynamic loads, applied to the tube matrix in a direction perpendicular to the manifolds, from said tube matrix to said housing.

21. A heat exchanger as claimed in claim 20 wherein said resilient means comprises resilient members fixed to said housing and each having a concave recess facing the bend region of said tube matrix and a corresponding curved bend region of an adjacent baffle wall.

22. A heat exchanger as claimed in claim 21 wherein said resilient member comprises a wire cushion made of chrome nickel steel.

23. A heat exchanger as claimed in claim 1 wherein each said manifold comprises a plurality of axially secured sections, each associated with a respective tube matrix section.

24. A heat exchanger as claimed in claim 23 comprising means connecting adjacent sections of the manifold together at locations in correspondence with a respective support.

25. A heat exchanger as claimed in claim 24 wherein each section of the manifold has ends with circumferential flanges and clasping means sealingly and rigidly connecting said circumferential flanges.

26. A heat exchanger as claimed in claim 25 wherein said clamping means comprises spaced circumferential clamping members gripping said flanges of adjacent section ends and means for applying clamping force to said flanges via said clamping members.

27. A heat exchanger as claimed in claim 26 wherein said means for applying a clamping fore comprises a turnbuckle.

28. A heat exchanger as claimed in claim 27 wherein said clamping members have V-shaped grooves engaging said flanges.

29. A heat exchanger as claimed in claim 1 wherein said means which connects said supports to said housing includes bolt means for accommodating differential thermal expansion between the supports and the housing.

* * * * *